United States Patent [19]

Hale

[11] Patent Number: 4,931,691

[45] **Date of Patent: * Jun. 5, 1990**

[54] ELECTRON GUN ASSEMBLY HAVING A REINFORCED HEATER TAB WITH LOCATING MEANS

[75] Inventor: John R. Hale, Lancaster, Pa.

[73] Assignee: RCA Licensing Corp., Princeton, N.J.

[ * ] Notice: The portion of the term of this patent subsequent to Dec. 6, 2005 has been disclaimed.

[21] Appl. No.: 238,079

[22] Filed: Aug. 30, 1988

[51] Int. Cl.[5] ..... H01J 29/02; H01J 29/48

[52] U.S. Cl. ..... 313/417; 313/446

[58] Field of Search ..... 313/417, 446, 451, 456, 313/457, 270, 337

[56] References Cited

U.S. PATENT DOCUMENTS

| | | | |
|---|---|---|---|
| 3,555,640 | 1/1968 | Lundvall, II | 29/25.16 |
| 3,973,163 | 8/1976 | Collins | 313/417 |
| 4,049,991 | 9/1977 | Collins | 313/417 |
| 4,251,746 | 2/1981 | Kawamura et al. | 313/345 |
| 4,403,169 | 9/1983 | Blanken | 313/446 |
| 4,484,102 | 11/1984 | Hale | 313/417 |
| 4,486,685 | 12/1984 | Hale et al. | 313/417 |
| 4,523,124 | 6/1985 | Blanken et al. | 313/446 |
| 4,595,858 | 6/1986 | Hale | 313/414 |
| 4,789,807 | 12/1988 | Hale | 313/446 |

*Primary Examiner*—Sandra L. O'Shea

*Attorney, Agent, or Firm*—Joseph S. Tripoli; Dennis H. Irlbeck; Vincent J. Coughlin, Jr.

[57] ABSTRACT

An electron gun assembly for use in a color CRT includes a pair of insulating support rods, three inline indirectly heated cathode disposed between the support rods, a heater for each of the cathodes and a pair of improved, reinforced heater tabs. The heater includes a pair of heater legs which are attached to the heater tabs. Heater bead straps are provided for attaching the heater tabs to the support rods. The electron gun also includes a plurality of electrodes for focusing and accelerating an electron beam generated by the cathodes. The reinforced heater tabs comprise a main body portion including a first and a second part. Each of the parts is attached to one of the heater legs. Each of the heater tabs has a pair of outwardly directed feet each of which is connected to one of the parts of the main body portion by a pair of substantially orthogonal legs extending therebetween. The reinforced heater tabs include a first reinforcing structure extending between the parts of the main body portion and the legs and a second reinforcing structure extending between the legs and the feet to maintain the rigidity of the heater tabs. The first reinforcing structure also provides locating means for a conformal heater tab associated with the center cathode of the electron gun.

6 Claims, 3 Drawing Sheets

Fig. 5
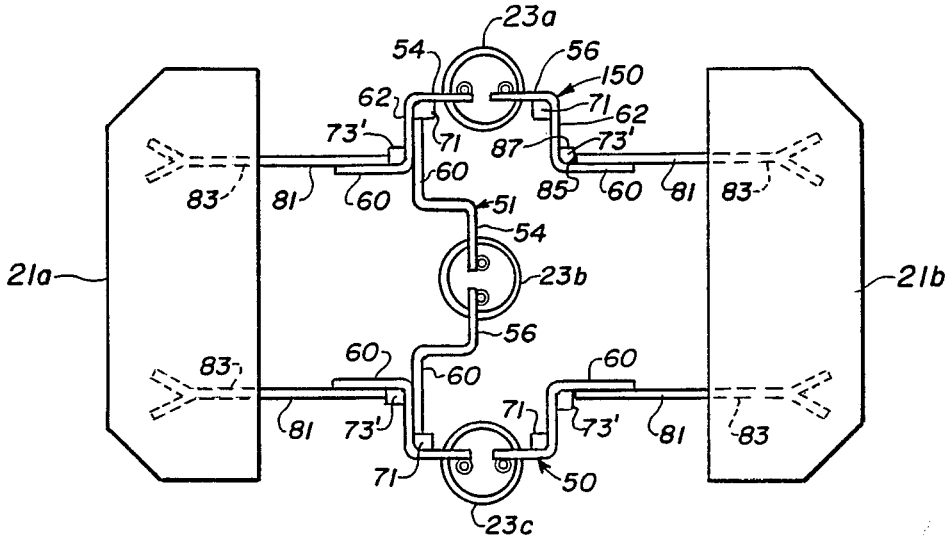
Fig. 4a
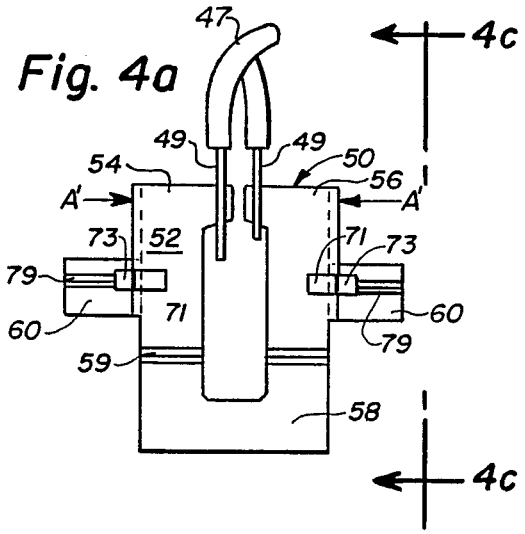
Fig. 4c
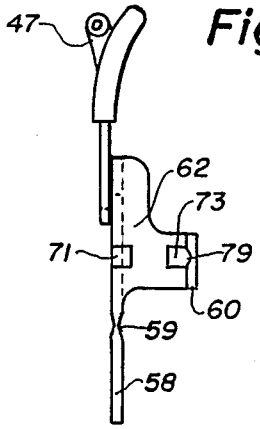
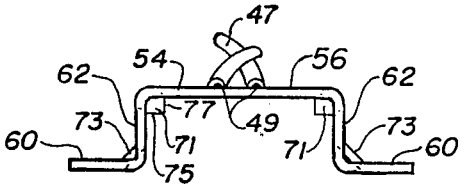
Fig. 4b

ELECTRON GUN ASSEMBLY HAVING A REINFORCED HEATER TAB WITH LOCATING MEANS

BACKGROUND OF THE INVENTION

This invention relates to an electron gun assembly having a pair of reinforced heater tabs each of which includes locating means to minimize cathode-ray tube, CRT, failure caused by a shorted conformal heater tab and to provide more accurate positioning of the conformal heater tab between the pair of reinforced heater tabs.

U.S. Pat. No. 3,555,640, issued to Lundvall on Jan. 19, 1971, discloses a method for mounting a heater within a tubular cathode. A U-shaped tab is welded to the legs of the heater, and a transverse portion of the tab is removed after the heater is positioned within the tubular cathode. The removal of the transition portion electrically isolates the arms of the tab so that the heater can be energized. The tab is shown as substantially flat; however, a step-like offset of the heater tab is shown in U.S. Pat. No. 4,523,124, issued to Blanken et al. on June 11, 1985. The offset facilitates centering of the heater within the tubular cathode and permits thermal expansion of the tab structure during tube operation, but provides little structural strength.

Copending U.S. patent application. Ser. No. 091,168 filed on Aug. 31, 1987, now U.S. Pat. No. 4,789,807 issued on Dec. 6, 1988 to the present inventor, discloses an inline electron gun assembly having at least one reinforced heater tab and, preferably, a pair of reinforced heater tabs which support and position the heaters for the outer cathodes of the inline electron gun. The reinforced heater tabs each include a main body portion, a pair of orthogonal legs extending from opposite sides of the main body portion and a pair of feet directed outwardly from the legs. Triangular gussets are formed between the main body portion and the legs and between the legs and the feet. The feet of each of the reinforced heater tabs are attached to the distal ends of oppositely disposed heater beads strap, the proximal ends of which are embedded into insulative support beads of the electron gun. The reinforced heater tabs are mutual parallel and provide a box-like structure with the support beads. A conformal heater tab. i.e., a heater tab without any reinforcing structure is disposed perpendicular to and attached between the reinforced heater tabs, preferably by welding. The feet of the conformal heater tab are attached to one of the legs of each of the reinforced heater tab in order to properly position the heater for the center cathode within the tubular center cathode. A drawback of this structure is that the feet of the conventional heater tab can be positioned anywhere along the legs of the reinforced heater tabs, and occasionally on one or both of the reinforcing gussets connecting the main body portion and the legs. Such misalignment of the conformal heater tab can result in the cathode heater contacting the tubular cathode sleeve, heat-sinking the heater, or, if the feet of the conformal heat tab are on the reinforcing gussets poor welding can occur which may result either in an open heater circuit or in weld-generated particles (i.e. weld-splash) within the electron gun.

SUMMARY OF THE INVENTION

An electron gun assembly for use in a color cathode-ray tube includes a pair of insulating support rods, three inline indirectly heated cathodes including a center cathode and two outer cathodes, disposed between the support rods, a heater with a pair of heater legs for each of the cathodes, and means for attaching the cathodes to the support rods. A pair of reinforced heater tabs are associated with the outer cathodes and a conformal heater tab is associated with the center cathode. Each of the heater tabs includes a main body portion having a first and a second part. Each of the parts are attached to one of the heater legs. Each of the heater tabs has a pair of outwardly directed feet which are connected to the parts of the main body portion by orthogonal legs extending therebetween. The reinforced heater tabs include a first reinforcing structure extending between the parts of the main body portion and the orthogonal legs. The first reinforcing structure comprises a substantially rectangular depression including first locating means. A second reinforcing structure extends between the orthogonal legs and the feet of the reinforced heater tabs. Oppositely disposed pairs of heater bead straps are secured to he support rods of the electron gun. The feet of the reinforced heater tabs are affixed to a different one of the oppositely disposed pairs of heater bead straps to provide a substantially rigid, box-like structure. The conformal heater tab is disposed transversely between the reinforced heater tabs with each of the feet of the conformal heater tab being positioned on one of the orthogonal legs of each of the reinforced heater tabs by the first locating means. The feet of the conformal heater tab are attached to the orthogonal legs of the reinforced heater tabs.

A second reinforcing structure, comprising either a gusset or a substantially rectangular depression extends between the orthogonal legs and feet of the

BRIEF DESCRIPTION OF THE DRAWINGS

FIGS. 4*a*, 4*b* and 4*c* show a first embodiment of a novel reinforced heater tab of the present invention during electron gun construction.

FIG. 5 is a bottom view showing a second embodiment of nested heater tabs of the electron gun of FIG. 1.

DETAILED DESCRIPTION OF THE PREFERRED EMBODIMENTS

Figure 1:
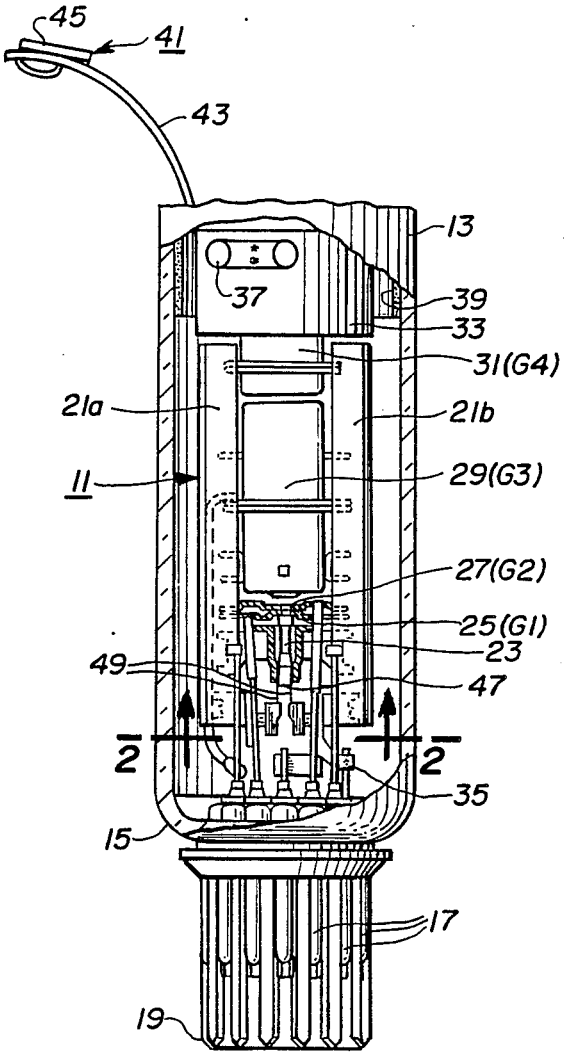
FIG. 1 is a broken away, side elevational view of an electron gun assembly incorporating the present invention.

FIG. 1 shows structural details of an inline electron gun 11 mounted in a neck 13 of a color cathode-ray tube. CRT. The CRT includes an evacuated glass envelope having a rectangular faceplate panel (not shown) and a funnel (also not shown) with the neck 13 integrally attached to the funnel. A glass stem 15, having a plurality of leads or pins 17 extending therethrough, is sealed to and closes the end of the neck 13. A base 19 is attached to the stem 15 and serves to locate and support the leads 17.

The inline electron gun 11 is centrally mounted within the neck 13 and is designed to generate and direct three electron beams along spaced, substantially co-planar, convergent paths towards a screen (not shown) on the faceplate panel. The gun assembly comprises two insulating glass support rods 21*a* and 21*b* from which various electrodes are supported to form a coherent unit in a manner well known in the art. These electrodes include three substantially equally transversely-spaced co-planar indirectly heated cathodes 23 one for producing each beam). a control grid electrode 25 (also referred to as G1). a screen grid electrode 27 (also referred to as G2). a first accelerating and focusing electrode 29 (also referred to as G3 and a second accelerating and focusing electrode 31 (also referred to as G4); longitudinally spaced, in the order named, along the support rods 21*a* and 21*b* A shield cup 33 is attached to the G4 electrode 31. The various electrodes of the gun assembly 11, excluding the G4 electrode, are electrically connected to the pins 17 either directly or through metal ribbons 35. The gun assembly 11 is centered within the neck 13 by snubbers 37 on the shield cup 33 which press on and make contact with an electrically conductive internal coating 39 on the inside surface of the neck 13. The internal coating 39 extends over the inner surface of the funnel and connects to an anode button (not shown). A getter assembly 41 comprises an elongated spring 43 which is attached at one end to the cup 33 and extends in cantilever fashion into the funnel of the envelope. A metal getter container 45 is attached to the other extended end of the spring 43.

The three cathodes 23 are substantially identical and comprise a cylinder closed at one end by a cap with a suitable electron emissive coating thereon. A heater 47, having a pair of heater legs 49, is disposed within each of the cathodes 23. The heater legs are attached, for example by welding, to a plurality of heater tabs.

Figure 2:
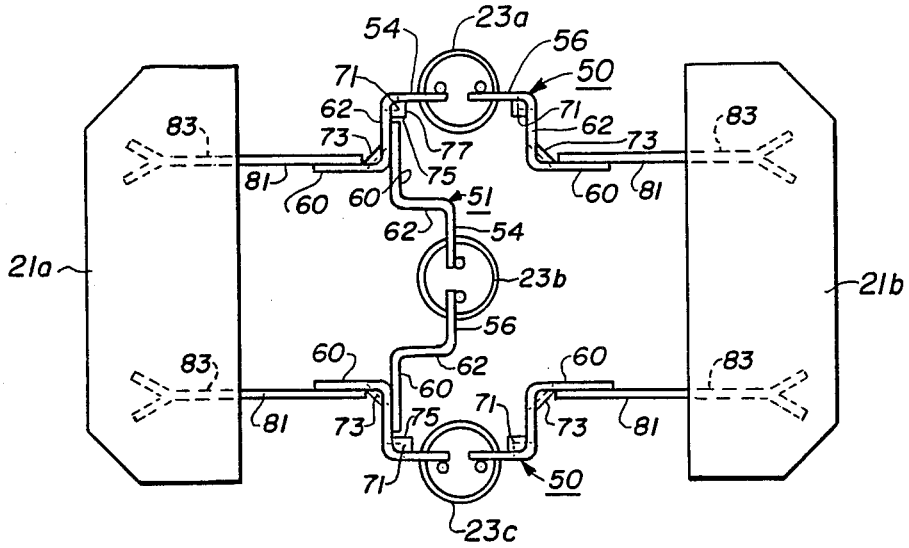
FIG. 2 is a bottom view along section line 2—2 showing a first embodiment of nested heater tabs of the electron gun of FIG. 1.
Figure 3A:
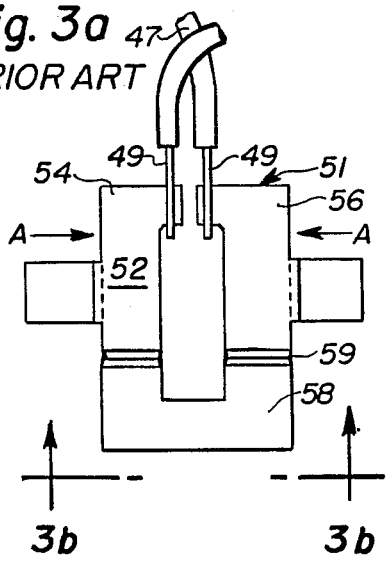
Fig. 3a PRIOR ART
FIGS. 3*a* and 3*b* are plan and bottom views, respectively, of a conventional conformal heater tab during electron gun construction.
Figure 3B:
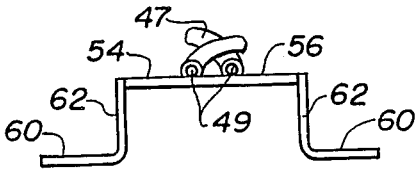
Fig. 3b PRIOR ART

As shown in FIG. 2, a pair of reinforced heater tabs 50 are associated with the outer cathodes 23*a* and 23*c* and a conventional, conformal heater tab 51 is associated with the center cathode 23*b*. With reference to FIGS. 3*a* and 3*b*, the conformal tab 51 comprises a main body portion 52 including a first part 54 and a second part 56 which are temporarily connected, during electron gun construction, by a removal portion 58 located below a score line 59. As shown in FIG. 3*b*, the conformal tab 51 includes a pair of outwardly directed feet 60 each of which is connected to the parts 54 and 56 of the main body portion 52 by substantially orthogonal legs 62 extending therebetween. The pair of heater legs 49 for the heater 47 are attached, for example by welding, to the parts 54 and 56.

With respect to FIGS. 4*a*, 4*b* and 4*c*, the novel reinforced heater tab 50 is similar to the conformal heater tab 51 (FIGS. 1*a* and 1*b*) and corresponding elements of the reinforced tab 50 are designated by the same numbers as used for the conformal tab 51. The reinforced heater tab 50 is different from the conformal tab 51 in that the reinforced tab 50 includes a first reinforcing structure comprising a first pair of oppositely disposed substantially rectangular first depression 71 formed between and comprising a segment of the two parts 54 and 56 of the main body portion 52 and the orthogonal legs 62, and a second reinforcing structure comprising a pair of oppositely disposed gussets 73 formed at about a 45° angle between and comprising a segment of the orthogonal legs 62 and the feet 60 The rectangular first depressions 71 includes a first endwall portion 75 and a second endwall portion 77. The first endwall portion 75 is substantially perpendicular to the orthogonal legs 62 and acts as a first locating means for the feet 60 of the conformal heater tab 51 as shown in FIG. 2. The second endwall portion 77 is substantially perpendicular to the main body portion 52 and to the first endwall portion 75. By way of example, the reinforced heater tab 50 is formed of 0.20 mm thick 304 stainless steel or nickel-iron. Each of the reinforcing structures 71 and 73 as a width of about 0.38 mm. The structures 71 and 73 reinforce the tab 50 by strengthening the interconnection between the parts 54 and 56 of the main body portion 52 and the orthogonal legs 62, and between the legs 62 and the attached feet 60. The reinforced tab 50 is more rigid and resistant to transverse motion in the direction A'—A' than the conformal tab 51, and thus is less likely to permit a heater short resulting from contact between the parts 51 and 56.

As described in U.S. Pat. No. 4,789,807 the reinforced heater tab 50 also includes a stamped portion 79, shown in FIGS. 4*a* and 4*c*, formed in one surface of each of the feet 60. The stamped portion 79 extends for a distance of about 0.08 mm into each of the feet 60 and flatten the feet to provide mechanical stability to the tab 50 without creating a protuberance on the opposite surface of each of the feet 60. The flattening facilitates attachment of the feet 60 of the tab 50 to a plurality of heater bead straps 81 which are shown in FIG. 2. A proximal end 83 of each of the heater bead straps 81 is embedded into the insulating support rods 21*a* and 21*b*. As shown in FIG. 3, the reinforced heater tabs 50 extend between oppositely disposed pairs of heater bead straps 81. The stamped portions 79 provide flat surfaces on the feet 60 to permit planar-to-planar contact between the feet 60 and the distal ends of the heater bead straps 81 and splash-free welding of the contacting components. The reinforced outer cathode) heater tabs 50, which are welded to the heater bead straps 81, provide a substantially rigid. box-like support structure (see FIG. 2) for the attachment of the conformal (center cathode) heater tab 51. The conformal heater tab 51, associated with the center cathode 23*b*, is a compliant structure without the reinforcing structures present in heater tabs 50. The conformal heater tab 51 has one foot 60 attached to a leg 62 of one of the heated tabs 50 and the other foot 60 attached to a leg 62 of the other heater tab 50. The conformal heater tab 51, associated with the center cathode 23*b*, accommodates to the configuration of the reinforced heater tabs 50 without distorting the nested arrangement of the heater tabs 50 and 51.

The first endwall portions 75 of the first depressions 71, formed in the reinforced heater tabs 50, more accurately locate and position the feet 60 of the conformal heater tab 51 than the triangularly shaped gussets, interconnecting the orthogonal legs and the parts of the main body portion of the reinforcing heater tabs, which are described in U.S. Pat. No. 4,789,807. To further facilitate the positioning of the feet 60 of the conformal heater tab 51 between the first depressions 71, the feet 60 of the conformal heater tab are shortened to provide an overall tab width of about 8.64 mm (0.340 inch). compared to an overall tab width of about 10.41 mm (0.410 inch) for the reinforced heater tabs 50.

After attachment of the conformal heater tab 51 to the reinforced heater tabs 50, the removal portions 58 (FIGS. 3*a*, 4*a* and 4*c*) of the heater tabs are detached at the score lines 59. The orientation of the parts 54 and 56 of the conformal heater tab 51 in a plane substantially parallel to the planes of the support rods 21*a* and 21*b* minimizes the compression on the conformal tab 50 and decreases the probability that the two parts 54 and 56 will experience a transverse motion that will cause the parts to contact one another. Accordingly, there is little likelihood that the nested heater tab structure of FIG. 2 will short-out.

A second embodiment of a novel reinforced heater tab is shown in FIG. 5. The second reinforced heater tab 150 is similar in all respects to the novel first reinforced heater tab 50 except that the second reinforcing structure, between the orthogonal legs 62 and the feet 60 comprises a substantially rectangular second depression 73' which includes a third endwall portion 85 and a fourth endwall portion 87. The third endwall portion 85 is substantially perpendicular to the feet 60 and acts as a second locating means for positioning the feet on the heater beads straps 81 to facilitate the interconnection thereof. The fourth endwall portion 87 is perpendicular to the orthogonal legs 62 and to the third endwall portion 85. The size of the second depression 73' is identical to that of the first depression 71.

What is claimed is:

1. In an electron gun assembly for use in a color cathode-ray tube, said gun assembly including a pair of insulating support rods, three inline indirectly heated cathodes including a center cathode and two outer cathodes for generating three electron beams, attachment means for attaching said cathodes to said support rods, a heater for each of said cathodes, each of said heaters having a pair of heater legs, a pair of reinforced heater tabs associated with said outer cathodes and a conformal heater tab associated with said center cathode, each of said heater tabs having a main body portion including a first and a second part, each of said parts being attached to a respective leg of one of said heaters, each of said heater tabs having a pair of outwardly directed feet, each of said feet being connected to a respective part of the parts of the main body portion by a pair of orthogonal legs extending therebetWeen, said reinforced heater tabs including a first reinforcing structure extending between said parts of said main body portion and said orthogonal legs, and also a second reinforcing structure extending between said orthogonal legs and said feet to maintain the rigidity of said reinforced heater tab, oppositely disposed pairs of heater bead straps secured to said support rods, said feet of said reinforced heater tabs being affixed to a different one of said oppositely disposed pairs of heater bead straps to provide a substantially rigid, box-like structure, said feet of said conformal heater tab being attached to one of said orthogonal legs of each of said reinforced heater tabs, said conformal heater tab being disposed between said reinforced heater tabs, wherein the improvement comprises said first reinforcing structure including a substantially rectangular first depression interconnecting each of said first and second parts of said main body portion and said orthogonal legs, each of said first depressions including first locating means for positioning said feet of said conformal heater tab or said orthogonal legs of each of said reinforced heater tabs.

2. The electron gun assembly of claim 1, wherein said rectangular first depression is formed in a segment of each of said first and second parts of said main body portion and said orthogonal legs.

3. The electron gun of claim 1, wherein said first locating means includes a first endwall portion of said first depression substantially perpendicular to said orthogonal legs of said reinforced heater tabs.

4. The electron gun of claim 1, wherein said second reinforcing structure includes a substantially rectangular second depression interconnecting each of said orthogonal legs and said feet of said reinforced heater tabs, each of said second depressions including second locating means for positioning said feet f said reinforced heater tabs relative to said pairs of heater bead straps.

5. The electron gun of claim 4, wherein said rectangular second depression is formed in a segment of each of said orthogonal legs and said feet of said reinforced heater tabs.

6. The electron gun of claim 4, wherein said second locating means includes a third endwall portion of said second depression substantially perpendicular to said feet of said reinforced heater tabs.

* * * * *

UNITED STATES PATENT AND TRADEMARK OFFICE
CERTIFICATE OF CORRECTION

PATENT NO. : 4,931,691

DATED : June 5, 1990

INVENTOR(S) : John R. Hale

It is certified that error appears in the above-identified patent and that said Letters Patent is hereby corrected as shown below:

Col. 1, line 61,
after "gussets" add --,--.

Col. 2, line 34,
after "the", second occurrence,
add --reinforced heater tab.--.

Col. 2, line 57,
after "tube" change "." to --,--.

Col. 3, line 7,
before "one" add --(--, and after
"beam)" change "." to --,--.

Col. 3, line 8,
after "G1)" change "." to --,--.

Col. 3, line 9,
after "G2)" change "." to --,--.

Col. 3, line 10,
after "G3" add --)--.

Col. 4, line 5,
change "as" to --has--.

UNITED STATES PATENT AND TRADEMARK OFFICE
CERTIFICATE OF CORRECTION

PATENT NO. : 4,931,691

DATED : June 5, 1990

INVENTOR(S) : John R. Hale

It is certified that error appears in the above-identified patent and that said Letters Patent is hereby corrected as shown below:

Col. 4, line 14,
change "51" to --54--.

Col. 4, line 33,
before "outer" add --(--.

Col. 4, line 35,
after "rigid" change "." to --,--.

Col. 4, line 41,
change "heated" to --heater--.

Col. 5, line 9,
after "60" add --,--.

Col. 5, line 36,
change "therebetWeen" to
--therebetween--.

Col. 6, line 15,
after "tab" change "or" to --on--.

UNITED STATES PATENT AND TRADEMARK OFFICE
CERTIFICATE OF CORRECTION

PATENT NO. : 4,931,691

DATED : June 5, 1990

INVENTOR(S) : John R. Hale

It is certified that error appears in the above-identified patent and that said Letters Patent is hereby corrected as shown below:

Col. 6, line 31,
change "f" to --of--.

Signed and Sealed this

Twenty-third Day of July, 1991

*Attest:*

*Attesting Officer*

HARRY F. MANBECK, JR.

*Commissioner of Patents and Trademarks*